US012674408B2

(12) United States Patent
Inoue et al.

(10) Patent No.: US 12,674,408 B2
(45) Date of Patent: Jul. 7, 2026

(54) SYSTEM FOR AND METHOD OF CONTROLLING WATERCRAFT

(71) Applicant: YAMAHA HATSUDOKI KABUSHIKI KAISHA, Iwata (JP)

(72) Inventors: Hiroshi Inoue, Shizuoka (JP); Norimitsu Nakatsugawa, Shizuoka (JP)

(73) Assignee: YAMAHA HATSUDOKI KABUSHUKI KAISHA, Shizuoka (JP)

( * ) Notice: Subject to any disclaimer, the term of this patent is extended or adjusted under 35 U.S.C. 154(b) by 523 days.

(21) Appl. No.: 17/982,711

(22) Filed: Nov. 8, 2022

(65) Prior Publication Data

US 2023/0243290 A1 Aug. 3, 2023

(30) Foreign Application Priority Data

Feb. 2, 2022 (JP) ..... 2022-015138

(51) Int. Cl.

| | |
|---|---|
| ***F01P 11/16*** | (2006.01) |
| ***F01P 3/20*** | (2006.01) |
| *B63B 79/15* | (2020.01) |
| *B63H 21/21* | (2006.01) |

(52) U.S. Cl.

CPC ..... *F01P 11/16* (2013.01); *F01P 3/202* (2013.01); *B63B 79/15* (2020.01); *B63H 21/21* (2013.01)

(58) Field of Classification Search

CPC ..... F01P 11/16; F01P 3/202; B63B 79/15; B63H 21/21

See application file for complete search history.

(56) References Cited

U.S. PATENT DOCUMENTS

| | | | | |
|---|---|---|---|---|
| 5,469,827 | A * | 11/1995 | Tomisawa | F02D 41/221 123/491 |
| 5,732,676 | A * | 3/1998 | Weisman | F02D 41/0007 123/436 |
| 7,056,165 | B2 * | 6/2006 | Saito | F02D 31/003 123/339.23 |
| 8,517,683 | B2 * | 8/2013 | Miocevich | B63H 1/28 416/62 |
| 2004/0242091 | A1 | 12/2004 | Okuyama et al. | |
| 2005/0042947 | A1 | 2/2005 | Saito | |

(Continued)

FOREIGN PATENT DOCUMENTS

| | | | |
|---|---|---|---|
| EP | 1519027 | A2 | 3/2005 |
| JP | 2000291478 | A | 10/2000 |

(Continued)

OTHER PUBLICATIONS

Extended European Search Report in EP22206641.7, mailed Jul. 5, 2023, 9 pages.

*Primary Examiner* — Jonathan M Dunlap
(74) *Attorney, Agent, or Firm* — Keating & Bennett, LLP

(57) ABSTRACT

A system to control a watercraft including an engine includes a first temperature sensor and a controller. The first temperature sensor is operable to detect a temperature of the engine. The controller is configured or programmed to obtain the temperature of the engine either upon an activation of the controller or a start of the engine. The controller is configured or programmed to estimate an environmental temperature of the watercraft based on the temperature of the engine obtained either upon the activation of the controller or the start of the engine.

14 Claims, 7 Drawing Sheets

(56) References Cited

U.S. PATENT DOCUMENTS

| | | | | |
|---|---|---|---|---|
| 2005/0071074 | A1 | 3/2005 | Super et al. | |
| 2008/0214069 | A1* | 9/2008 | Kawanishi | B63H 21/00 440/84 |
| 2008/0270002 | A1* | 10/2008 | Bamba | G07C 5/0816 701/99 |
| 2011/0106505 | A1 | 5/2011 | Hawkins et al. | |
| 2015/0066256 | A1* | 3/2015 | Sako | F02D 41/2451 701/21 |
| 2017/0121003 | A1 | 5/2017 | Tokuda | |
| 2019/0265111 | A1* | 8/2019 | Ungerbuehler | G01K 13/08 |
| 2021/0336576 | A1* | 10/2021 | Ikitake | H02P 27/08 |

FOREIGN PATENT DOCUMENTS

| | | | |
|---|---|---|---|
| JP | 2003328867 | A | 11/2003 |
| JP | 2008045455 | A | 2/2008 |
| JP | 2008-064720 | A | 3/2008 |

* cited by examiner

SYSTEM FOR AND METHOD OF CONTROLLING WATERCRAFT

CROSS REFERENCE TO RELATED APPLICATIONS

This application claims the benefit of priority to Japanese Patent Application No. 2022-015138 filed on Feb. 2, 2022. The entire contents of this application are hereby incorporated herein by reference.

BACKGROUND OF THE INVENTION

1. Field of the Invention

The present invention relates to a system for and a method of controlling a watercraft.

2. Description of the Related Art

There is a type of watercraft embedded with a variety of sensors for detecting environmental conditions thereof. For example, Japan Laid-open Patent Application Publication No. 2008-064720 describes a watercraft embedded with sensors including a wind speed direction meter, an air temperature meter, a water temperature meter, and so forth.

When a watercraft is embedded with sensors dedicated for detecting the environmental conditions thereof as described above, a cost increase is inevitable due to addition of the sensors.

SUMMARY OF THE INVENTION

Preferred embodiments of the present invention provide information about target environmental conditions of watercraft without adding a new sensor.

A system according to a preferred embodiment of the present invention relates to a system for controlling a watercraft including an engine. The system includes a first temperature sensor and a controller. The first temperature sensor is operable to detect a temperature of the engine. The controller is configured or programmed to obtain the temperature of the engine either upon an activation of the controller or a start of the engine. The controller is configured or programmed to estimate an environmental temperature of the watercraft based on the temperature of the engine obtained either upon the activation of the controller or the start of the engine.

A method according to another preferred embodiment of the present invention relates to a method of controlling a watercraft. The watercraft includes an engine and a controller configured or programmed to control the engine. The method includes obtaining a temperature of the engine either upon an activation of the controller or a start of the engine and estimating an environmental temperature of the watercraft based on the temperature of the engine obtained either upon the activation of the controller or the start of the engine.

According to a preferred embodiment of the present invention, the environmental temperature is estimated based on the temperature of the engine obtained either upon the activation of the controller or the start of the engine. The temperature of the engine, obtained either upon the activation of the controller or the start of the engine, approximates the environmental temperature. Therefore, the environmental temperature is accurately obtained with a sensor operable to detect the temperature of the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
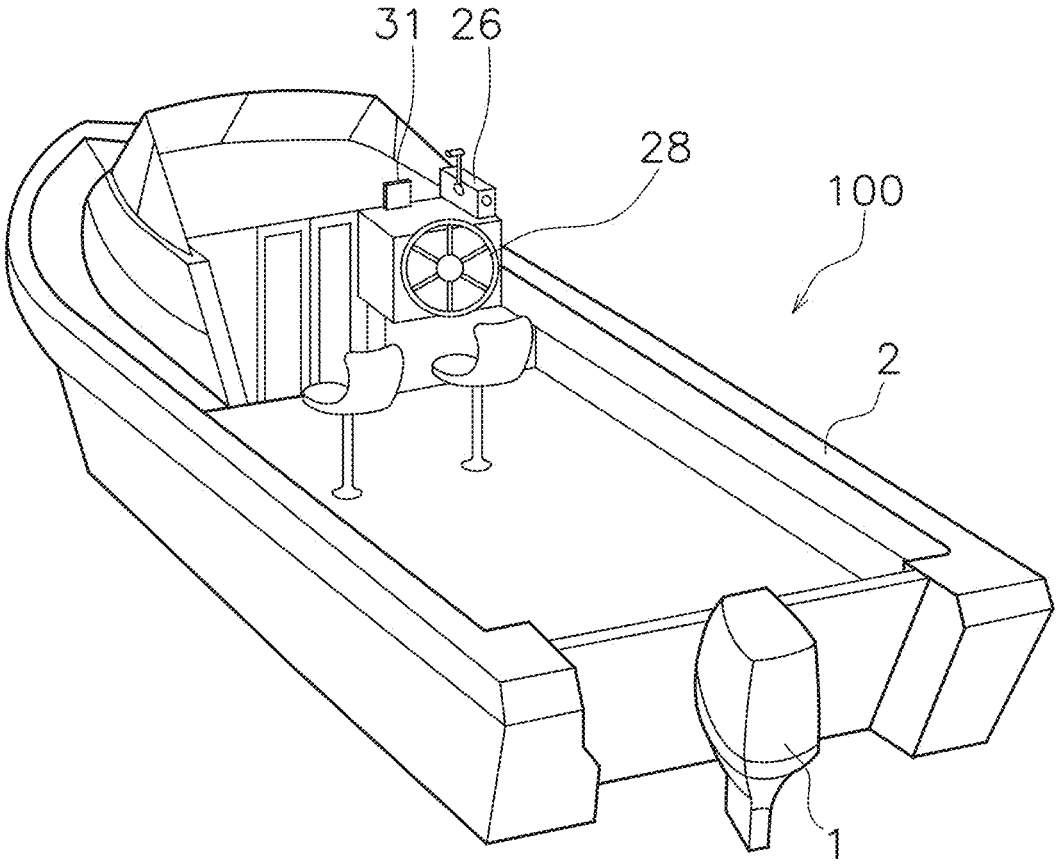
FIG. 1 is a perspective view of a watercraft according to a preferred embodiment of the present invention.

Preferred embodiments of the present invention will be hereinafter explained with reference to the drawings. FIG. 1 is a perspective view of a watercraft 100 according to a preferred embodiment of the present invention. The watercraft 100 includes a marine propulsion device 1 and a vessel body 2. The marine propulsion device 1 is attached to the stern of the vessel body 2. The marine propulsion device 1 generates a thrust to propel the watercraft 100. In the present preferred embodiment, the marine propulsion device 1 is an outboard motor.

Figure 2:
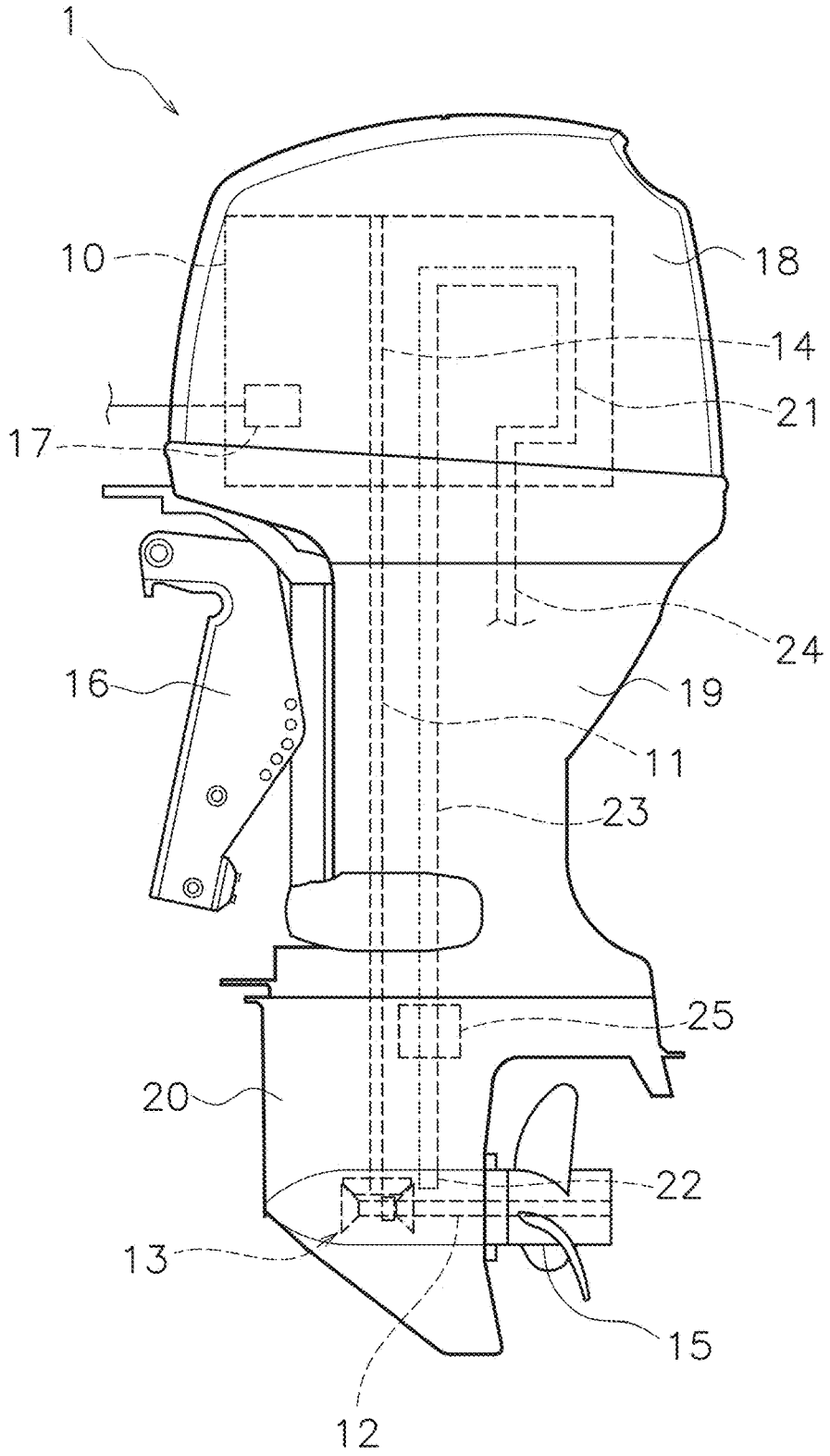
FIG. 2 is a side view of a marine propulsion device.

FIG. 2 is a side view of the marine propulsion device 1. As shown in FIG. 2, the marine propulsion device 1 includes an engine 10, a drive shaft 11, a propeller shaft 12, and a shift mechanism 13. The engine 10 generates the thrust to propel the watercraft 100. The engine 10 includes a crankshaft 14. The crankshaft 14 extends in the vertical direction. The drive shaft 11 is connected to the crankshaft 14. The drive shaft 11 extends in the vertical direction. The drive shaft 11 extends downward from the engine 10.

The propeller shaft 12 extends in the back-and-forth direction of the marine propulsion device 1. The propeller shaft 12 is connected to the drive shaft 11 through the shift mechanism 13. A propeller 15 is connected to the propeller shaft 12. The shift mechanism 13 switches the rotational direction of mechanical power to be transmitted from the drive shaft 11 to the propeller shaft 12. The shift mechanism 13 includes, for instance, a plurality of gears and a clutch that changes meshing of the gears. The marine propulsion device 1 is attached to the watercraft 100 through a bracket 16.

The marine propulsion device 1 includes an ECU (Engine Control Unit) 17. The ECU 17 electrically controls the engine 10. The ECU 17 includes a processor such as a CPU (Central Processing Unit) and memories such as a RAM (Random Access Memory) and a ROM (Read Only Memory).

The marine propulsion device 1 includes an engine cowl 18, an upper case 19, and a lower case 20. The engine 10 is disposed inside the engine cowl 18. The upper case 19 is disposed below the engine cowl 18. The lower case 20 is disposed below the upper case 19. The drive shaft 11 is disposed inside the upper case 19 and the lower case 20. The propeller shaft 12 is disposed inside the lower case 20.

The engine 10 includes a water jacket 21. The engine 10 is cooled by cooling water flowing through the water jacket 21. The marine propulsion device 1 includes a water inlet 22, a cooling water pathway 23, a discharge water pathway 24, and a water pump 25. The water inlet 22 is provided in the lower case 20. The cooling water pathway 23 and the water discharge pathway 24 are connected to the water jacket 21 of the engine 10. The cooling water pathway 23 and the water discharge pathway 24 are disposed inside the upper case 19 and the lower case 20.

The water pump 25 draws in external water (e.g., seawater) existing outside the marine propulsion device 1 and supplies the engine 10 with the drawn in external water as the cooling water. The water pump 25 takes in the external water through the water inlet 22 and sends the external water through the cooling water pathway 23 to the water jacket 21 of the engine 10. The cooling water is discharged from the water jacket 21 through the water discharge pathway 24 to the outside of the marine propulsion device 1.

Figure 3:
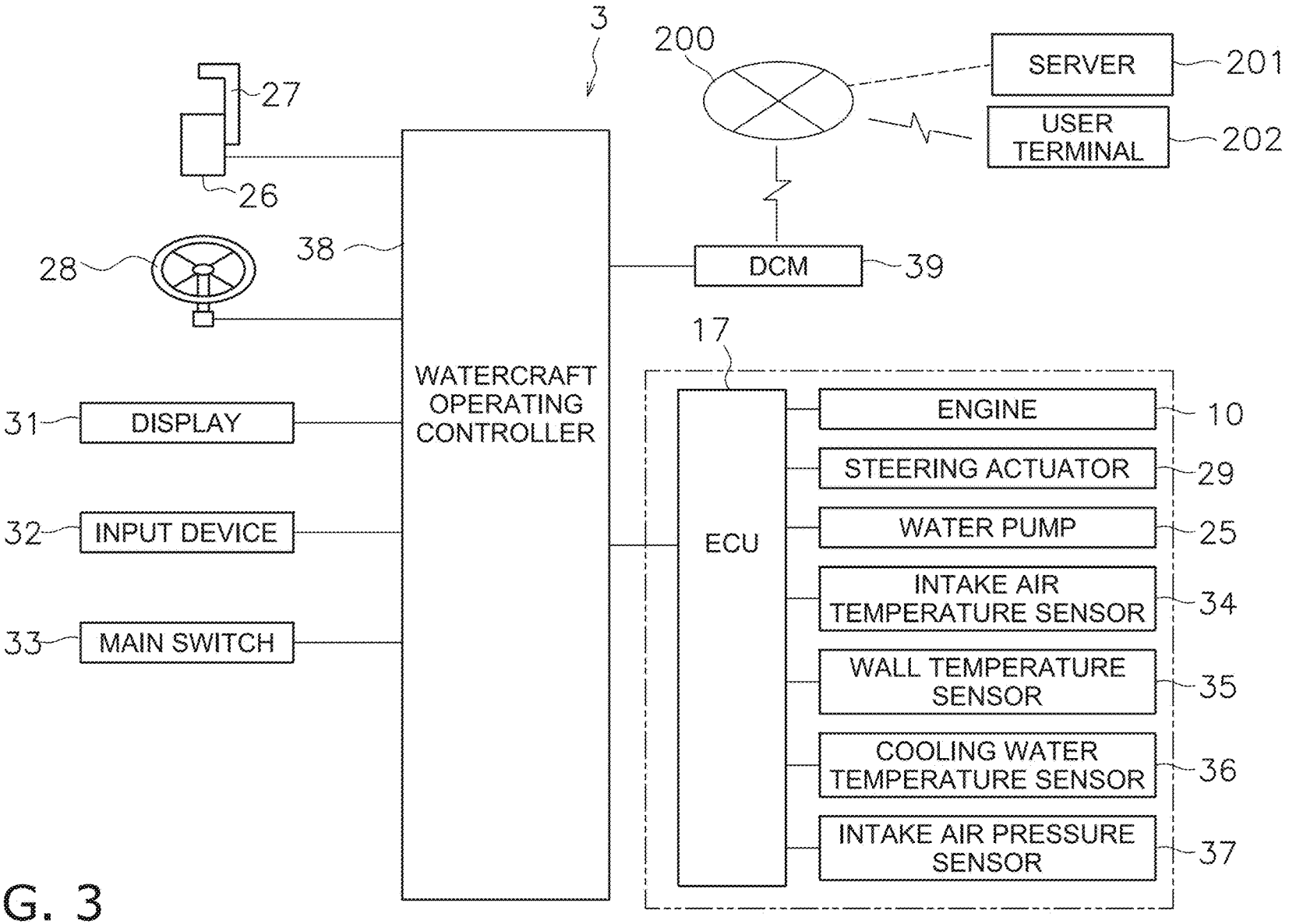
FIG. 3 is a schematic diagram of a control system for the watercraft.

FIG. 3 is a schematic diagram for showing a configuration of a control system 3 for the watercraft 100. As shown in FIG. 3, the control system 3 includes a throttle-shift operating device 26. The throttle-shift operating device 26 is operable by an operator to regulate the rotational speed of the engine 10 in the marine propulsion device 1. The throttle-shift operating device 26 is also operable by the operator to switch forward movement and rearward movement of the marine propulsion device 1.

The throttle-shift operating device 26 includes a throttle lever 27. The throttle lever 27 is operable from a neutral position to a forward moving position and a rearward moving position. The throttle-shift operating device 26 outputs a throttle signal indicating the operating position of the throttle lever 27. The ECU 17 receives the throttle signal outputted from the throttle-shift operating device 26. The ECU 17 controls the shift mechanism 13 in accordance with the operating position of the throttle lever 27. Accordingly, the rotation of the propeller shaft 12 is switched between a forward moving direction and a rearward moving direction. The ECU 17 controls the engine rotational speed in accordance with the operating position of the throttle lever 27.

The control system 3 includes a steering operating device 28 and a steering actuator 29. The steering actuator 29 turns the marine propulsion device 1 right and left so as to change the rudder angle of the marine propulsion device 1. The steering actuator 29 includes, for instance, an electric motor. Alternatively, the steering actuator 29 may include an electric pump and a hydraulic cylinder.

The steering operating device 28 is operable by the operator to adjust the rudder angle of the marine propulsion device 1. The steering operating device 28 includes, for instance, a steering wheel. Alternatively, the steering operating device 28 may be another type of operating device such as a joystick. The steering operating device 28 is operable right and left from a neutral position. The steering operating device 28 outputs a steering signal indicating the operating position thereof. The steering actuator 29 is controlled in accordance with the operating position of the steering operating device 28, such that the rudder angle of the marine propulsion device 1 is controlled.

The control system 3 includes a display 31 and an input device 32. The display 31 displays information regarding the marine propulsion device 1. The display 31 displays an image in response to an image signal inputted thereto. The input device 32 receives an operational input from a user. The input device 32 outputs an input signal indicating the operational input by the user. The input device 32 includes, for instance, a touchscreen. It should be noted that the input device 32 may include at least one hardware key.

The control system 3 includes an intake air temperature sensor 34, a wall temperature sensor 35, a cooling water temperature sensor 36, and an intake air pressure sensor 37. The intake air temperature sensor 34, the wall temperature sensor 35, the cooling water temperature sensor 36, and the intake air pressure sensor 37 are provided in the marine propulsion device 1. The intake air temperature sensor 34 outputs a signal indicating intake air temperature data. The intake air temperature data indicates the intake air temperature of the engine 10. The wall temperature sensor 35 outputs a signal indicating wall temperature data. The wall temperature data indicates the wall temperature of the engine 10. The wall temperature of the engine 10 includes, for instance, the temperature of the wall surface of the combustion chamber in the engine 10. The cooling water temperature sensor 36 outputs a signal indicating cooling water temperature data. The cooling water temperature data indicates the temperature of the cooling water flowing through the water jacket 21 of the engine 10. The intake air pressure sensor 37 outputs a signal indicating intake air pressure data. The intake air pressure data indicates the intake air pressure of the engine 10.

The control system 3 includes a watercraft operating controller 38 and a data communication module (hereinafter referred to as DCM) 39. The watercraft operating controller 38 includes a processor such as a CPU, memories such as a RAM and a ROM, and a storage such as an HDD (Hard Disk Drive) or an SSD (Solid State Drive). The watercraft operating controller 38 stores programs and data to control the marine propulsion device 1. The watercraft operating controller 38 is connected to the ECU 17 through wired or wireless communication. The watercraft operating controller 38 is connected to the throttle-shift operating device 26 and the steering operating device 28 through wired or wireless communication.

The control system 3 includes a main switch 33. The main switch 33 is operable by the operator. When the main switch 33 is turned on, the watercraft operating controller 38 is activated. When the main switch 33 is turned on, the engine 10 is started.

The watercraft operating controller 38 receives the input signal outputted from the input device 32. The watercraft operating controller 38 initiates the control of the marine propulsion device 1 in response to the input signal. The watercraft operating controller 38 outputs the image signal to the display 31 and causes the display 31 to display the information regarding the marine propulsion device 1.

The watercraft operating controller 38 obtains the intake air temperature data from the intake air temperature sensor 34. The watercraft operating controller 38 obtains the wall temperature data from the wall temperature sensor 35. The watercraft operating controller 38 obtains the cooling water temperature data from the cooling water temperature sensor 36. The watercraft operating controller 38 obtains the intake air pressure data from the intake air pressure sensor 37. The watercraft operating controller 38 records the intake air temperature data, the wall temperature data, the cooling water temperature data, and the intake air pressure data at predetermined intervals of time.

The watercraft operating controller 38 determines an occurrence of malfunctioning or abnormality of the engine 10 based on the intake air temperature data, the wall temperature data, the cooling water temperature data, or the intake air pressure data. For example, the watercraft operating controller 38 determines an occurrence of overheating of the engine 10 based on the cooling water temperature data. For example, the watercraft operating controller 38 determines that overheating of the engine 10 is occurring when the temperature of the cooling water is greater than or equal to a predetermined threshold of temperature. When it is determined that malfunctioning or abnormality of the engine 10 is occurring, the watercraft operating controller 38 causes the display 31 to display an alert. Alternatively, when it is determined that malfunctioning or abnormality of the engine 10 is occurring, the watercraft operating controller 38 may turn on a warning lamp.

The DCM 39 performs wireless communication with an external computer. The DCM 39 includes a processor such as a CPU, memories such as a RAM and a ROM, and an auxiliary storage device such as an HDD or an SSD. The DCM 39 is capable of performing data transmission with the external computer through a mobile communication network 200. The mobile communication network 200 is, for instance, a network of a 3G, 4G, or 5G mobile communication system.

The DCM 39 is communicable with a server 201. The DCM 39 is communicable with a user terminal 202. The user terminal 202 may be, for instance, a smartphone, a tablet, or a personal computer. The DCM 39 may be communicable with the user terminal 202 through the server 201.

The DCM 39 collects watercraft data regarding the watercraft 100 and sends the collected watercraft data to the server 201. The DCM 39 sends the watercraft data to the server 201 at predetermined intervals of time. The watercraft data includes the aforementioned data, i.e., the intake air temperature data, the wall temperature data, the cooling water temperature data, and the intake air pressure data.

The watercraft operating controller 38 obtains a temperature of the engine 10 upon a start of the engine 10 and estimates an environmental temperature of the watercraft 100 based on the temperature of the engine 10 obtained upon the start of the engine 10. For example, the watercraft operating controller 38 estimates an external temperature based on an intake air temperature obtained upon the start of the engine 10. The watercraft operating controller 38 estimates a temperature of the external water based on a temperature of the cooling water obtained upon the start of the engine 10.

Figure 4:
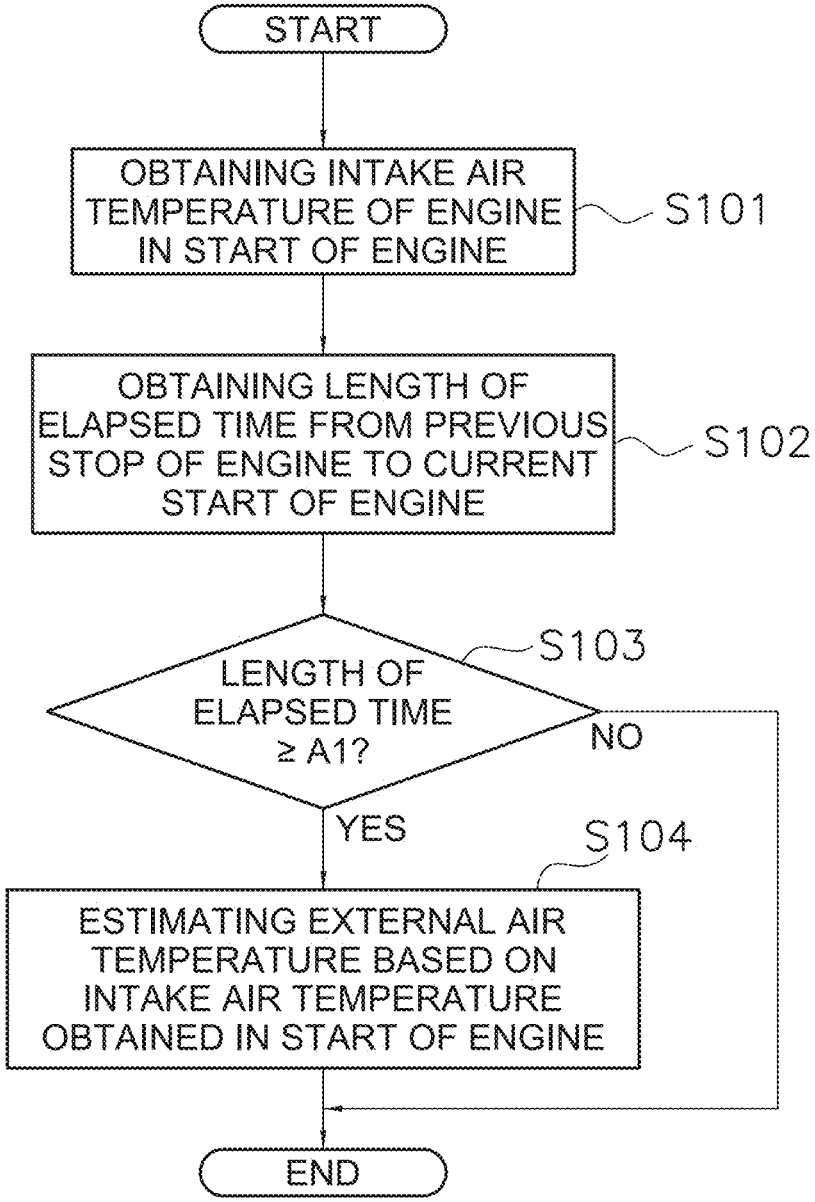
FIG. 4 is a flowchart of a series of processes for estimating an external air temperature.

FIG. 4 is a flowchart of a series of processes for estimating an external air temperature. As shown in FIG. 4, in step S101, the watercraft operating controller 38 obtains an intake air temperature of the engine 10 upon a start of the engine 10. The watercraft operating controller 38 obtains, from the intake air temperature data, the intake air temperature of the engine 10 upon the start of the engine 10. The watercraft operating controller 38 obtains an intake air temperature of the engine 10 upon a turn-on operation of the main switch 33 as the intake air temperature of the engine 10 upon the start of the engine 10.

In step S102, the watercraft operating controller 38 obtains a length of elapsed time from a previous stop of the engine 10 to a current start of the engine 10. The watercraft operating controller 38 stores a set of date and clock time of each start of the engine 10 and each stop of the engine 10. For example, the watercraft operating controller 38 stores a set of date and clock time upon a turn-off operation of the main switch 33. The watercraft operating controller 38 stores a set of date and clock time upon a turn-on operation of the main switch 33. The watercraft operating controller 38 calculates the length of elapsed time based on the set of date and clock time stored upon the turn-on operation of the main switch 33 and upon the turn-off operation of the main switch 33.

In step S103, the watercraft operating controller 38 determines whether or not the length of elapsed time is greater than or equal to a length-of-time threshold A1. The length-of-time threshold A1 is defined as, for instance, a length of time enough for the temperature of the engine 10 to sufficiently reduce to a temperature close to the external air temperature after the stop of the engine 10. When the length of elapsed time is greater than or equal to the length-of-time threshold A1, the process proceeds to step S104.

In step S104, the watercraft operating controller 38 estimates the external air temperature based on the intake air temperature obtained upon the start of the engine 10. The watercraft operating controller 38 sets the value of the intake air temperature obtained upon the start of the engine 10 as the external air temperature.

Figure 5:
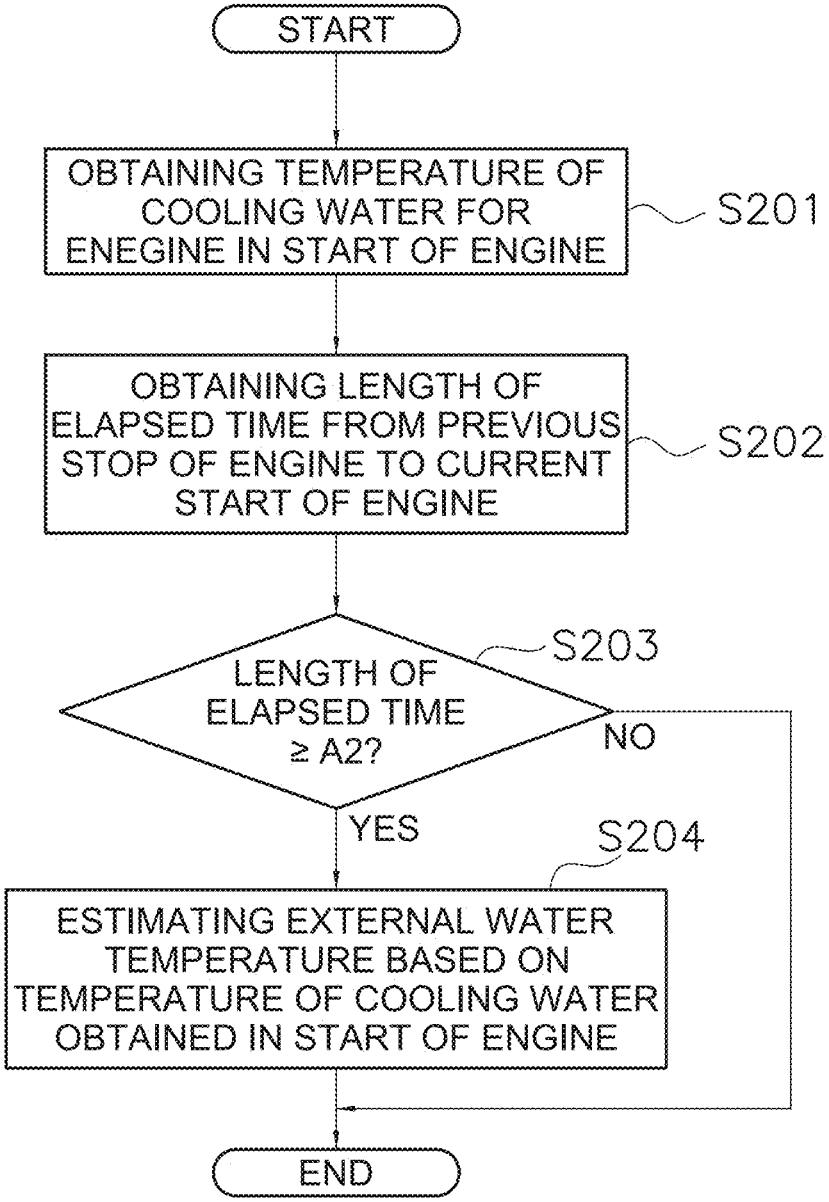
FIG. 5 is a flowchart of a series of processes for estimating an external water temperature.

FIG. 5 is a flowchart of a series of processes for estimating an external water temperature. As shown in FIG. 5, in step S201, the watercraft operating controller 38 obtains a temperature of the cooling water for the engine 10 upon a start of the engine 10. The watercraft operating controller 38 obtains, from the cooling water temperature data, the temperature of the cooling water for the engine 10 upon the start of the engine 10. The watercraft operating controller 38 obtains a temperature of the cooling water for the engine 10 upon a turn-on operation of the main switch 33 as the temperature of the cooling water for the engine 10 upon the start of the engine 10.

In step S202, the watercraft operating controller 38 obtains a length of elapsed time from a previous stop of the engine 10 to a current start of the engine 10 in a similar manner to step S102.

In step S203, the watercraft operating controller 38 determines whether or not the length of elapsed time is greater than or equal to a length-of-time threshold A2. The length-of-time threshold A2 is defined as, for instance, a length of time enough for the temperature of the engine 10 to sufficiently reduce to a temperature close to an external air temperature after the stop of the engine 10. When the length of elapsed time is greater than or equal to the length-of-time threshold A2, the process proceeds to step S204.

In step S204, the watercraft operating controller 38 estimates the external water temperature based on the temperature of the cooling water obtained upon the start of the engine 10. The watercraft operating controller 38 sets the value of the temperature of the cooling water obtained upon the start of the engine 10 as the external water temperature.

Figure 6:
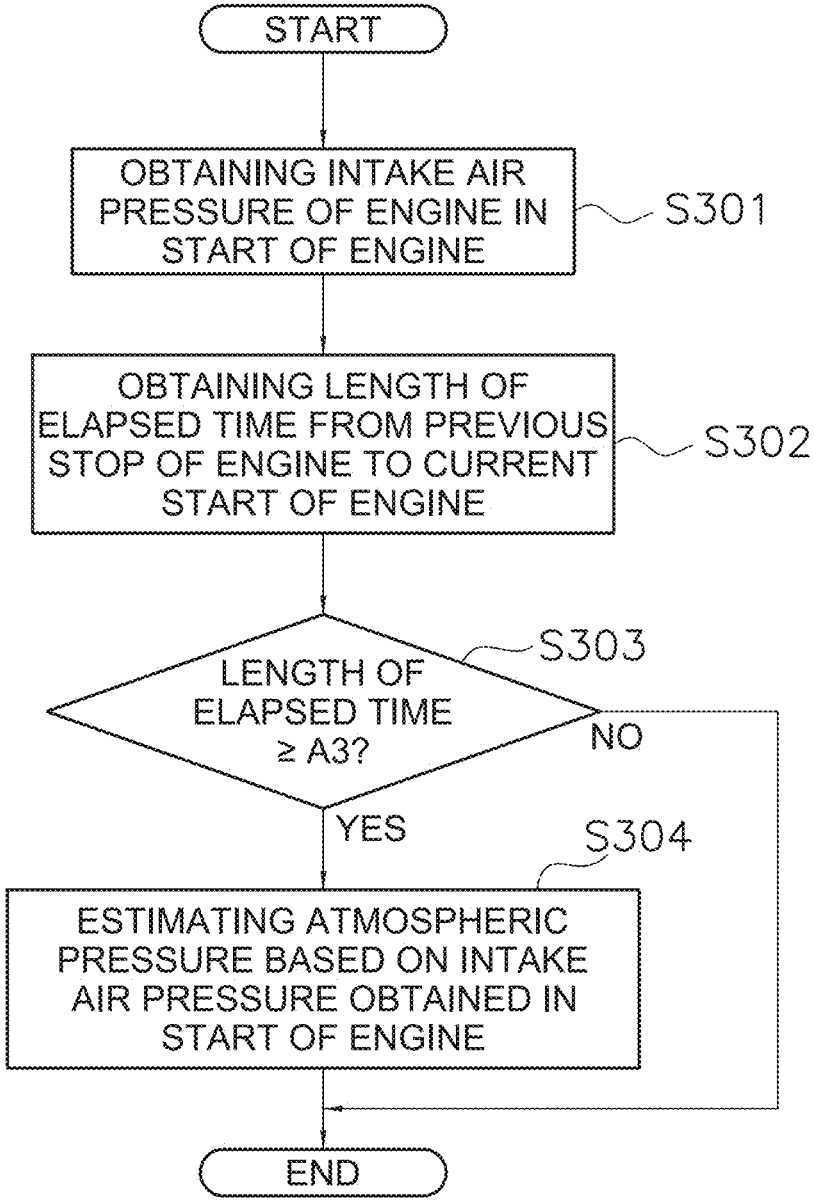
FIG. 6 is a flowchart of a series of processes for estimating an atmospheric pressure.

FIG. 6 is a flowchart of a series of processes for estimating an atmospheric pressure. As shown in FIG. 6, in step S301, the watercraft operating controller 38 obtains an intake air pressure of the engine 10 upon a start of the engine 10. The watercraft operating controller 38 obtains, from the intake air pressure data, the intake air pressure of the engine 10 upon the start of the engine 10. The watercraft operating controller 38 obtains an intake air pressure of the engine 10 upon a turn-on operation of the main switch 33 as the intake air pressure of the engine 10 upon the start of the engine 10.

In step S302, the watercraft operating controller 38 obtains a length of elapsed time from a previous stop of the engine 10 to a current start of the engine 10 in a similar manner to step S102.

In step S303, the watercraft operating controller 38 determines whether or not the length of elapsed time is greater than or equal to a length-of-time threshold A3. The length-of-time threshold A3 is defined as, for instance, a length of time enough for the temperature of the engine 10 to sufficiently reduce to a temperature close to an external air temperature after the stop of the engine 10. When the length of elapsed time is greater than or equal to the length-of-time threshold A3, the process proceeds to step S304.

In step S304, the watercraft operating controller 38 estimates the atmospheric pressure based on the intake air pressure obtained upon the start of the engine 10. The watercraft operating controller 38 sets the value of the intake air pressure obtained upon the start of the engine 10 as the atmospheric pressure.

As described above, the watercraft operating controller 38 estimates the external air temperature, the external water temperature, and the atmospheric pressure. The watercraft operating controller 38 may send the estimated external temperature, external water temperature, and atmospheric pressure as the watercraft data to the server 201. The watercraft operating controller 38 may determine malfunctioning or abnormality of the marine propulsion device 1 or of the watercraft 100 based on the estimated external air temperature, external water temperature, and atmospheric pressure. The watercraft operating controller 38 may cause the display 31 to display the estimated external air temperature, external water temperature, or atmospheric pressure.

In the control system 3 for the watercraft 100 according to a preferred embodiment of the present invention, the external air temperature is estimated based on the intake air temperature of the engine 10 obtained upon the start of the engine 10. The intake air temperature of the engine 10 obtained upon the start of the engine 10 is approximate to the external air temperature. Therefore, the external air temperature is accurately estimated with the intake air temperature sensor 34.

The external water temperature is estimated based on the temperature of the cooling water for the engine 10 obtained upon the start of the engine 10. The temperature of the cooling water for the engine 10 obtained upon the start of the engine 10 is approximate to the external water temperature. Therefore, the external water temperature is accurately estimated with the cooling water temperature sensor 36.

The atmospheric pressure is estimated based on the intake air pressure of the engine 10 obtained upon the start of the engine 10. The intake air pressure of the engine 10 obtained upon the start of the engine 10 is approximate to the atmospheric pressure. Therefore, the atmospheric pressure is accurately estimated with the intake air pressure sensor 37.

Preferred embodiments of the present invention have been explained above. However, the present invention is not limited to the preferred embodiments described above, and a variety of changes can be made without departing from the gist of the present invention.

The marine propulsion device 1 is not limited to the outboard motor, and alternatively, may be another type of propulsion device such as an inboard engine outboard drive or a jet propulsion device. The structure of the marine propulsion device 1 is not limited to that in the preferred embodiments described above and may be changed. The structure of the control system 3 is not limited to that in the preferred embodiments described above and may be changed. For example, the DCM 39 may be omitted.

The series of processes for estimating the external air temperature, the external water temperature, or the atmospheric pressure are not limited to those in the preferred embodiments described above and may be changed. For example, FIG. 7 is a flowchart of a series of processes for estimating an external air temperature according to a modification.

Figure 7:
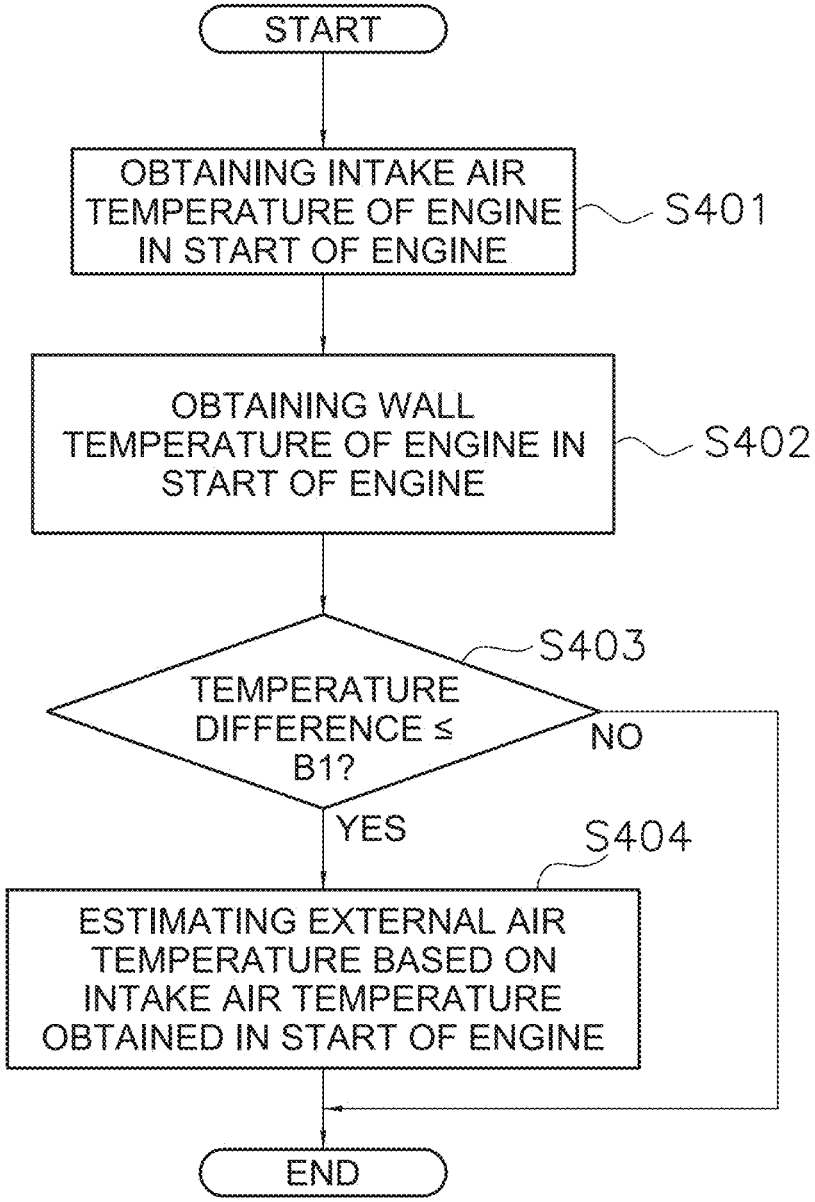
FIG. 7 is a flowchart of a series of processes for estimating an external air temperature according to a modification.

As shown in FIG. 7, a process step of S401 is similar to that of S101 described above. In step S402, the watercraft operating controller 38 obtains a wall temperature of the engine 10 upon the start of the engine 10. The watercraft operating controller 38 obtains, from the wall temperature data, the wall temperature of the engine 10 upon the start of the engine 10. The watercraft operating controller 38 obtains a wall temperature of the engine 10 upon a turn-on operation of the main switch 33 as the wall temperature of the engine 10 upon the start of the engine 10.

In step S403, the watercraft operating controller 38 determines whether or not a temperature difference between the wall temperature and the intake air temperature is less than or equal to a temperature threshold B1. When the temperature difference between the wall temperature and the intake air temperature is less than or equal to the temperature threshold B1, the process proceeds to step S404. In step S404, the watercraft operating controller 38 estimates the external air temperature based on the intake air temperature obtained upon the start of the engine 10 in a similar manner to step S104.

Likewise, in the series of processes for estimating the external water temperature shown in FIG. 5, the process steps of S402 and S403 may be executed instead of those of S202 and S203. Still likewise, in the series of processes for estimating the atmospheric pressure shown in FIG. 6, the process steps of S402 and S403 may be executed instead of those of S302 and S303.

When the watercraft operating controller 38 has been activated but the engine 10 has been stopped, the watercraft operating controller 38 may estimate an environmental temperature of the watercraft 100 based on a temperature of the engine 10 to be obtained upon the activation of the watercraft operating controller 38. For example, the watercraft operating controller 38 may estimate an external air temperature based on an intake air temperature to be obtained upon the activation of the watercraft operating controller 38. The watercraft operating controller 38 may estimate an external water temperature based on a temperature of the cooling water to be obtained upon the activation of the watercraft operating controller 38. The watercraft operating controller 38 may estimate an atmospheric pressure based on an intake air pressure of the engine 10 to be obtained upon the activation of the watercraft operating controller 38.

Estimation of the external air temperature, the external water temperature, and the atmospheric pressure may not be necessarily executed by the watercraft operating controller 38, and instead, may be executed by another computer. For example, estimation of the external air temperature, the external water temperature, and the atmospheric pressure may be executed by the server 201.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a watercraft including an engine, the system comprising:

a first temperature sensor to detect an intake air temperature of the engine;

a second temperature sensor to detect an engine wall temperature;

a display to display information regarding the engine; and a controller configured or programmed to:

obtain the air intake temperature of the engine either upon an activation of the controller or a start of the engine;

obtain an engine wall temperature upon the activation of the controller or the start of the engine;

estimate an external air temperature based on the intake air temperature obtained either upon the activation of the controller or the start of the engine when a difference between the engine wall temperature and the intake air temperature is less than or equal to a threshold; and determine an occurrence of malfunctioning or abnormality of the watercraft based on the estimated external air temperature; and display an alert on the display when it is determined that malfunctioning or abnormality of the engine occurs; wherein the system does not include a sensor to detect the external air temperature.

2. The system according to claim 1, wherein the watercraft includes a main switch to activate the controller; and the controller is configured or programmed to estimate the external air temperature based on the intake air temperature to be obtained upon a turn-on operation of the main switch.

3. The system according to claim 1, further comprising:

a pressure sensor to detect an intake air pressure of the engine; wherein the controller is configured or programmed to:

obtain the intake air pressure either upon the activation of the controller or the start of the engine; and estimate an atmospheric pressure based on the intake air pressure obtained either upon the activation of the controller or the start of the engine; wherein the system does not include a sensor to detect the atmospheric pressure.

4. The system according to claim 3, wherein the watercraft includes a main switch to activate the controller; and the controller is configured or programmed to estimate the atmospheric pressure based on the intake air pressure to be obtained upon a turn-on operation of the main switch.

5. A system for controlling a watercraft including an engine and a water pump to draw in external water to supply the engine with the external water as a cooling water of the engine, the system comprising:

a first temperature sensor to detect a cooling water temperature of the engine;

a display to display information regarding the engine; and a controller configured or programmed to:

obtain the cooling water temperature of the engine either upon an activation of the controller or a start of the engine;

estimate a temperature of the external water based on the cooling water temperature obtained upon the activation of the controller or the start of the engine;

determine an occurrence of malfunctioning or abnormality of the watercraft based on the estimated temperature of the external water; and display an alert on the display when it is determined that malfunctioning or abnormality of the engine occurs; wherein the system does not include a sensor to detect the external water temperature.

6. The system according to claim 5, further comprising:

a second temperature sensor to detect the engine wall temperature; wherein the controller is configured or programmed to estimate the temperature of the external water based on the cooling water temperature obtained upon the start of the engine when a difference between the engine wall temperature and the cooling water temperature is less than or equal to a threshold.

7. The system according to claim 5, wherein the controller is configured or programmed to:

obtain a length of elapsed time from a previous stop of the engine to a current start of the engine; and estimate the temperature of the external water based on the cooling temperature obtained upon the start of the engine when the length of elapsed time is greater than or equal to a threshold.

8. A method of controlling a watercraft including an engine and a controller to control the engine, the method comprising:

obtaining an intake air temperature of the engine either upon an activation of the controller or a start of the engine;

obtaining an engine wall temperature either upon the activation of the controller or the start of the engine;

estimating an external air temperature based on the intake air temperature obtained either upon the activation of the controller or the start of the engine in response to a difference between the engine wall temperature and the intake air temperature being less than or equal to a threshold;

determining an occurrence of malfunctioning or abnormality of the watercraft based on the estimated external air temperature; and displaying an alert on a display when it is determined that malfunctioning or abnormality of the engine occurs; wherein the watercraft does not include a sensor to detect the external air temperature.

9. The method according to claim 8, wherein the watercraft includes a main switch to activate the controller, the method further comprising:

estimating the external air temperature based on the intake air temperature to be obtained upon a turn-on operation of the main switch.

10. The method according to claim 8, further comprising:

obtaining an intake air pressure of the engine either upon the activation of the controller or the start of the engine; and estimating an atmospheric pressure based on the intake air pressure obtained either upon the activation of the controller or the start of the engine; wherein the watercraft does not include a sensor to detect the atmospheric pressure.

11. The method according to claim 10, wherein the watercraft includes a main switch to activate the controller, the method further comprising:

estimating the atmospheric pressure based on the intake air pressure to be obtained upon a turn-on operation of the main switch.

12. A method of controlling a watercraft including an engine, a water pump to draw in external water to supply the engine with the external water as a cooling water of the engine, and a controller to control the engine, the method comprising:

obtaining a cooling water temperature of the engine either upon an activation of the controller or a start of the engine; and estimating a temperature of the external water based on the cooling water temperature obtained upon the activation of the engine or the start of the engine;

determining an occurrence of malfunctioning or abnormality of the watercraft based on the estimated temperature of the external water; and displaying an alert on a display when it is determined that malfunctioning or abnormality of the engine occurs; wherein the watercraft does not include a sensor to detect the temperature of the external water.

13. The method according to claim 12, further comprising:

detecting the engine wall temperature; and estimating the temperature of the external water based on the cooling water temperature obtained upon the start of the engine when a difference between the engine wall temperature and the cooling water temperature is less than or equal to a threshold.

14. The method according to claim 12, further comprising:

obtaining a length of elapsed time from a previous stop of the engine to a current start of the engine; and estimating the temperature of the external water based on the cooling water temperature obtained upon the start of the engine when the length of elapsed time is greater than or equal to a threshold.

* * * * *